US005768921A

United States Patent [19]

Hill

[11] Patent Number: 5,768,921

[45] Date of Patent: Jun. 23, 1998

[54] KEY BOX DEVICE

[75] Inventor: Matthew S. Hill, Salem, Oreg.

[73] Assignee: Supra Products, Inc., Salem, Oreg.

[21] Appl. No.: 844,537

[22] Filed: Apr. 18, 1997

[51] Int. Cl.[6] ..... E05B 65/52

[52] U.S. Cl. ..... 70/63; 70/58; 70/169; 70/445; 109/64; 220/212; 220/212.5; 220/789

[58] Field of Search ..... 70/58, 63, 158–173, 70/207, 445; 109/58, 64, 74, 75; 220/212, 212.5, 789

[56] References Cited

U.S. PATENT DOCUMENTS

| | | | |
|---|---|---|---|
| 344,055 | 6/1886 | Melveny | 70/159 |
| 603,489 | 5/1898 | Staudenmayer | 70/169 |
| 1,934,319 | 11/1933 | Newbauer | 70/58 X |
| 2,207,827 | 7/1940 | Schuyler et al. | 70/168 |
| 3,695,067 | 10/1972 | Bays | 70/63 |
| 4,626,007 | 12/1986 | Larson | 592/65 |
| 4,768,021 | 8/1988 | Ferraro | 70/63 X |
| 4,831,851 | 5/1989 | Larson | 70/303 A |
| 4,836,368 | 6/1989 | Cotton | 220/212 X |
| 4,936,894 | 6/1990 | Larson et al. | 70/298 |

FOREIGN PATENT DOCUMENTS

| | | | |
|---|---|---|---|
| 1211983 | 3/1960 | France | 70/162 |
| 1214802 | 12/1970 | United Kingdom | 109/64 |

OTHER PUBLICATIONS

Supra RV Keyboxes brochure, 4 pages, Jan. 1995, Supra, 2611 Pringle Road, S.E., Salem, Oregon 97302.

*Primary Examiner*—Lloyd A. Gall

*Attorney, Agent, or Firm*—Klarquist Sparkman Campbell Leigh & Whinston, LLP

[57] ABSTRACT

A lid is secured to the base of a key box device that defines an enclosed compartment for securing a spare key. The lid carries push-buttons and a knob for locking the lid to the base. The surface of the lid is generally flush with the plane of the base edges thereby eliminating locations for prying the lid from the base. A flanged portion in the lid and corresponding recessed portion in the base sidewalls provide gripping sidewalls to facilitate handling of the lid.

9 Claims, 1 Drawing Sheet

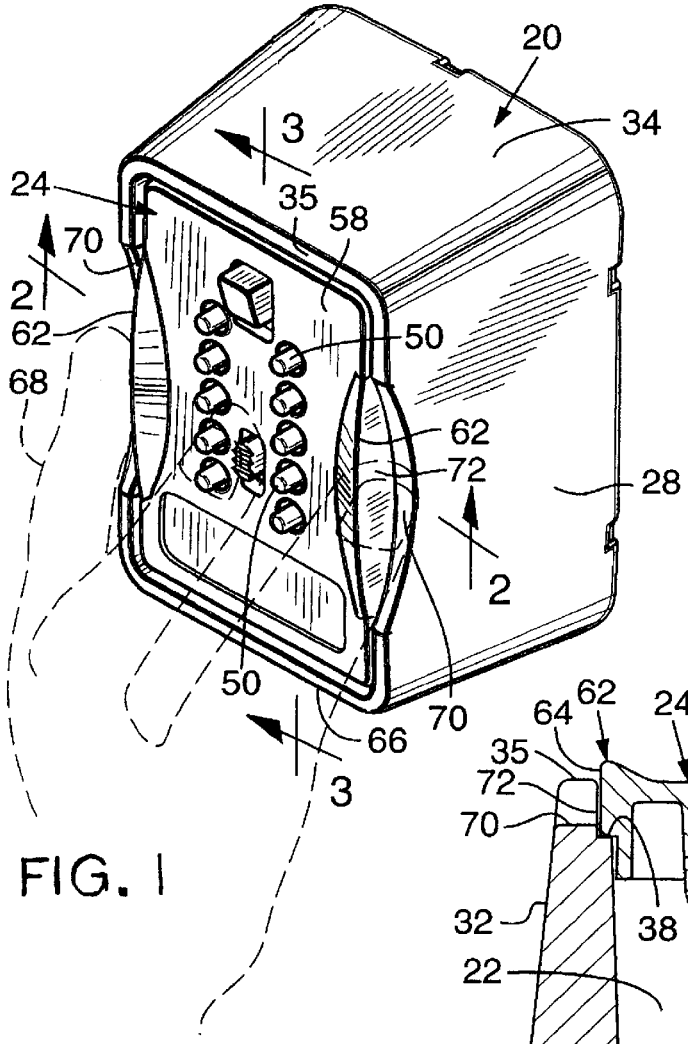
FIG. 1
FIG. 2
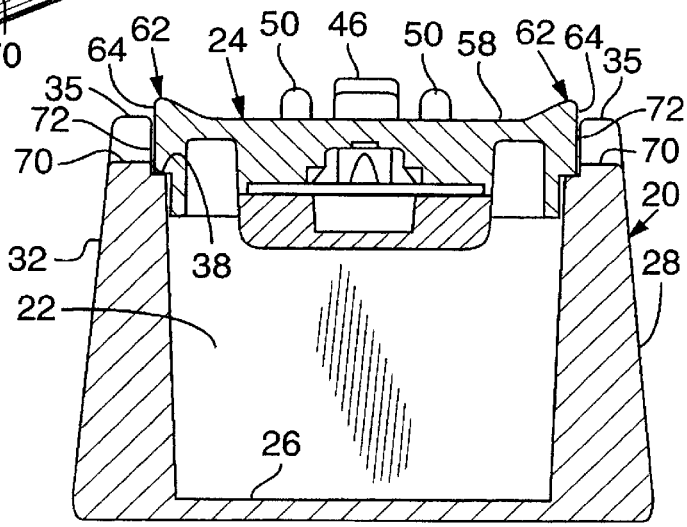
FIG. 3
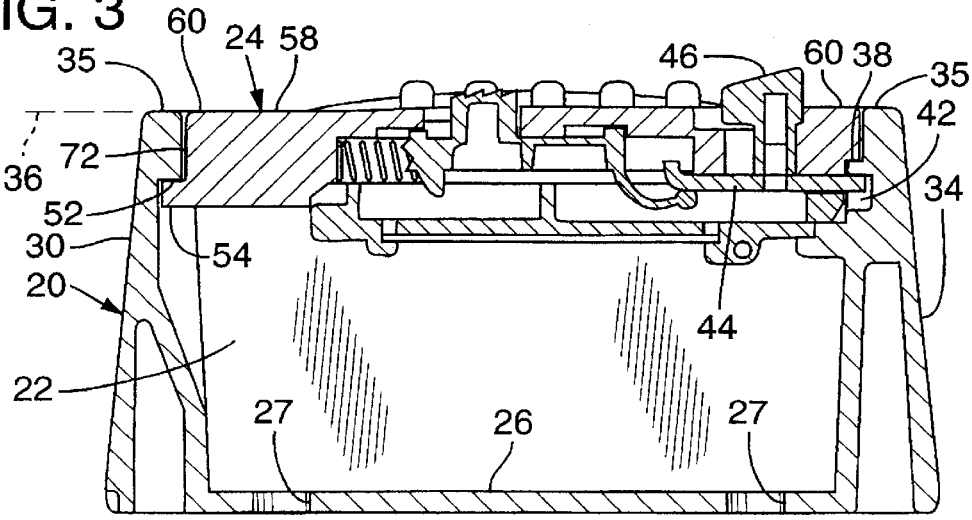

KEY BOX DEVICE

FIELD OF THE INVENTION

The present invention relates to a device known as a key box, which is used for securing a spare key within a compartment. The compartment is accessible by removing a lid to the key box. The lid may be removed after operating a plurality of buttons on the lid to enter a code.

BACKGROUND AND SUMMARY OF THE INVENTION

Push-button operated key boxes have been available for several years, including the device designated "KeySafe," manufactured by Supra Products Inc. of Salem, Oreg. The particulars of the locking mechanism for such a key box are described in U.S. Pat. No. 4,936,894, hereby incorporated by reference.

Prior push-button-type key boxes include a base that can be mounted to a wall and that defines a compartment in which a spare key may be stored. The compartment is closed by a lid. The lid carries buttons on its outer surface for entering a code. The lid also has a knob that is moved for retracting a lock bolt that underlies the lid and permits the lid to be removed from the base to access the compartment once the proper code is entered.

In order to enable one to easily handle the lid in moving it to and from the base, prior lids were configured to protrude somewhat from the base, thereby providing exposed edges on the lid for gripping while moving the lid into and out of engagement with the base. The exposed edges of the lid, however, define a small space between the lid and the base within which a thin prying device may be placed for applying leverage to pry apart the lid and base in an attempt at unauthorized entry to the compartment. The portion of the lid most vulnerable to successful prying is in the region nearest the underlying lock bolt.

To defeat this prying approach, the edges of the lid of prior devices are rounded so that the tip of the prying device will tend to slip from the edge, or otherwise not develop significant force in the direction for separating the lid from the base.

An approach to more enhanced protection against prying is to recess the lid so that its surface is flush with the side edges of the base so that there is no exposed part of the lid against which a prying device can be applied for forcing the lid in the direction away from the base. It is difficult to grip the lid, however, if it is flush with or recessed relative to the base.

The present invention is directed to a key box device that includes a lid having an outer surface that is for the most part flush with the outer edges of the base of the key box, thereby eliminating locations against which a prying device can be applied for forcing the lid in the direction away from the base.

In one embodiment, the lid includes two opposing flanged parts that protrude from the surface of the lid to provide gripping surfaces to facilitate manual gripping of the lid for moving the lid relative to the base.

In a preferred embodiment, the edge of the base includes recessed portions that expose a small region of the side surfaces of the lid that are contiguous with the gripping surfaces of the flange, thus increasing the overall region of the lid that may be gripped by a user when attaching or removing the lid. Since elimination of the prying locations is particularly important in the vicinity of the base where the bolt of the lid engages the base (when the lid is locked to the base), the flush or coplanar portions of the base are located there, and the flanged parts of the lid are located away from the area where the lid engages the base.

The foregoing and additional features and advantages of the present invention will be more readily apparent from the following detailed description, which proceeds with reference to the accompanying drawings.

BRIEF DESCRIPTION OF THE DRAWINGS

FIG. 1 is a perspective view of a key box in accordance with a preferred embodiment of the present invention.

FIG. 2 is a cross section taken along line 2—2 of FIG. 1.

FIG. 3 is a cross section taken along line 3—3 of FIG. 1.

DETAILED DESCRIPTION

Referring to FIGS. 1–3, a key box according to a preferred embodiment of the invention includes a base 20 having a five walls that define a compartment 22. The compartment is accessible when a lid 24 is removed from the base.

The base includes a back wall 26 having a number of apertures 27 formed in it so that threaded fasteners may be used to fasten the back wall 26 to a structure such as a door frame.

The base includes sidewalls 28, 30, 32, 34 that protrude outwardly from the back wall and terminate in outer edges 35 that, except for portions as described below, are in a common plane illustrated as dashed line 36 in FIG. 3.

The interior portions of the base sidewalls include a substantially continuous shoulder 38 against which an inner corresponding shoulder, of the lid 24 abuts when the lid is attached to the base, as best shown in FIG. 2.

At the top of the base, the sidewall 34 includes a pocket 42 into which a retractable lock bolt 44 fits. The lock bolt 44 is carried on the lid and is retractable when the moveable knob 46 is retracted (that is, moved right to left in FIG. 3) once the correct combination of push buttons 50 carried on the lid 24 are depressed.

Opposite the pocket 42 is a ledge 52 that is formed in the sidewall 30 of the base to secure a protruding rim 54 of the lid when the lid 24 is attached and locked to the base 20.

The base configuration, including shoulder 38, and that of the lid 24 is such that when the lid is locked to the base as shown in FIGS. 1 and 3 the outer planar surface 58 of the lid is flush or coplanar with the plane 36 defined by the outer edges 35 of the base. This coplanar relationship appears best in FIG. 3. In particular, all of the margins 60 of the lid surface are flush with all of the edges 35 of the sidewalls 34, 30 that extend along the portion of the lid that carries the locking bolt 44 and rim 54. It will be appreciated that, as a result of this configuration, the junction of the base edges 35 and the margins 60 of the lid surface 58 present no abutment or surface against which a prying member may be placed to apply leverage in the direction for separating the lid from the base.

Moreover, the base edges 35 and the lid surface margins 60 are rounded so that any prying device that nay be fit into the minute space between the lid and the base will tend to slip away when forced against either of those components.

Opposing flanged parts 62 are formed in the lid 24 to protrude outwardly somewhat from the substantially planar outer surface 58 of the lid, thereby to facilitate handling of the lid in removing and replacing it relative to the base. The protrusions may be of any shape or size and, preferably, define two gripping surfaces 64 that are spaced apart and in parallel planes, and are exposed for gripping by, for example, a thumb 66 and middle finger 68 of a user.

The opposite sidewalls 28, 32 of the base include recessed portions 70 that are recessed inwardly (that is, toward the back wall 26) from the plane 36 of the outer edges 35 of the sidewalls. Any shape may be used for the recessed portions, including the curved or arcuate shape depicted in FIG. 1. The recesses expose some of the peripheral side surfaces 72 of the lid 24, which surfaces are otherwise obscured by the base side walls 28, 32 when the lid is attached to the base.

The exposed side surfaces 72 of the lid are contiguous with the gripping surfaces 64 of the protruding part 62 of the lid (FIG. 2), thereby enlarging the gripping surface or region where the user may grip the lid with thumb and middle finger as mentioned above. When one grips the surfaces 64 as noted, the index finger is free to manipulate the buttons and knob for locking and unlocking the lid. Once unlocked, the lid is easily removed and replaced.

It is contemplated that the flanged parts 62 of the lid may be sized to provide sufficient gripping surfaces 64 for holding the lid without the need for recessed portions 70 formed in the edges of the sidewalls as described above in connection with a preferred embodiment. Moreover, it is also contemplated that flanged parts 62 may not be necessary in an embodiment that carries the recessed portions 70. It is desirable, however, to ensure that the maximum distance that the recessed portions are recessed from the plane 36 does not exceed the thickness (as measured from top to bottom in FIGS. 2 and 3) of the lid. With this constraint, a prying device will be unable to seat against any surface that would facilitate applying a force in a direction necessary for separating the lid from the base.

It should be recognized that the foregoing embodiments are illustrative only and should not be taken as limiting the scope of the invention. Instead, what is claimed as the invention is all such modifications as may come within the scope and spirit of the following claims and equivalents thereto.

I claim:

1. A key box device, comprising:

a base defining a compartment and having an opening to the compartment on one side thereof, the base including sidewalls that have outer edges that terminate in a plane;

a lid attachable to the base for covering the opening and closing the compartment, the lid having an outer surface that includes a margin that is disposed in the plane when the lid is attached to the base, except for opposing manual gripping flanged parts along peripheral side surfaces of the lid that protrude from the plane away from the base.

2. The device of claim 1 wherein each flanged part has a planar gripping surface parallel to and spaced from the other planar gripping surface, thereby to facilitate manual gripping of the lid for moving the lid relative to the base.

3. The device of claim 1 wherein the edges of the base and the margin of the lid surface are rounded.

4. The device of claim 1 wherein the lid has peripheral side surfaces that are substantially obscured by the base when the lid is attached thereto and wherein opposing sidewalls of the base are shaped to have portions that are recessed from the outer edges, thereby to expose regions of the side surfaces that are contiguous with each gripping part to permit one to simultaneously grip the gripping part and the contiguous regions of the side surfaces.

5. A key box device, comprising a base defining a compartment and having an opening to the compartment on one side thereof, the base including sidewalls that have outer edges that terminate in a plane, a lid attachable to the base for covering the opening and closing the compartment, the lid having an outer surface that includes margins that are disposed in the plane when the lid is attached to the base, and wherein the lid has peripheral side surfaces that are substantially obscured by the base when the lid is attached thereto wherein the lid includes opposing flanged parts along peripheral side surfaces of the lid that protrude from the plane away from the base; and wherein opposing sidewalls of the base are shaped to have portions that are recessed from the outer edges, thereby to expose regions of the side surfaces and facilitate manual gripping of the lid side surfaces for moving the lid relative to the base.

6. The device of claim 5 wherein each flanged part has a planar gripping surface parallel to and spaced from the other planar gripping surface, thereby to facilitate manual gripping of the lid for moving the lid relative to the base.

7. The device of claim 5 wherein the edges of the base and the margins of the lid surface are rounded.

8. The device of claim 5 wherein the recessed portions of the base are arcuate.

9. The device of claim 5 wherein the lid side surfaces have a thickness and wherein the maximum distance the recessed portions are recessed from the plane of the edges is less than the thickness of the side surfaces.

* * * * *